US007784650B2

(12) United States Patent
Bates et al.

(10) Patent No.: US 7,784,650 B2
(45) **Date of Patent: *Aug. 31, 2010**

(54) SPRAYER ACTUATOR, SPRAYER, AND METHOD OF MAKING THE SAME

(75) Inventors: Christopher Eugene Bates, Cincinnati, OH (US); Chow-chi Huang, West Chester, OH (US); Stephen Henry Iding, Cincinnati, OH (US); Naomi Ruth Nelson, Cincinnati, OH (US); Ricky Ah-Man Woo, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 523 days.

This patent is subject to a terminal disclaimer.

(21) Appl. No.: 11/599,788

(22) Filed: Nov. 15, 2006

(65) Prior Publication Data

US 2007/0062980 A1 Mar. 22, 2007

Related U.S. Application Data

(63) Continuation of application No. 10/429,629, filed on May 5, 2003, now abandoned.

(51) Int. Cl.
*B65D 83/00* (2006.01)
*B65D 88/54* (2006.01)

(52) U.S. Cl. ..... 222/402.13; 222/402.15; 222/321.8; 222/383.1

(58) Field of Classification Search ..... 222/321.8, 222/321.7, 321.9, 383.1, 402.13, 402.15, 222/402, 402.1, 401, 402.11, 402.12, 402.14, 222/321.1, 631, 635, 183, 323, 324, 470, 222/472, 473, 474; 215/382, 383, 384; 220/669, 220/675

See application file for complete search history.

(56) References Cited

U.S. PATENT DOCUMENTS

| | | | |
|---|---|---|---|
| 3,189,232 | A | 6/1965 | Joffe |
| 3,580,432 | A | 5/1971 | Brooks |
| 3,987,942 | A | 10/1976 | Morane et al. |
| 4,088,246 | A | 5/1978 | Klingaman |
| 4,417,673 | A | 11/1983 | Hancock |

(Continued)

FOREIGN PATENT DOCUMENTS

| | | |
|---|---|---|
| CA | 99667 | 9/2006 |

(Continued)

OTHER PUBLICATIONS http://www.kokusen.go.jp/pdf/n-20010606 ; Translation of p. 20; published by the National Consumer Affairs Center of Japan on Jun. 6, 2001.

*Primary Examiner*—Kevin P Shaver
*Assistant Examiner*—Stephanie E Tyler
(74) *Attorney, Agent, or Firm*—Larry Huston; Amy I Ahn-Roll; Leonard W Lewis

(57) ABSTRACT

A sprayer actuator, a sprayer, and a method of making the same are disclosed. In one embodiment, the sprayer includes an ergonomic sprayer actuator with a housing having an upper portion, a lower portion for fitting over a can, and a narrowed waist portion between the upper portion and the lower portion.

30 Claims, 3 Drawing Sheets

U.S. PATENT DOCUMENTS 5,147,075 A * 9/1992 Regan ..... 222/402.15
5,366,121 A 11/1994 Foster et al.
5,570,840 A 11/1996 Gettinger et al.
5,597,095 A * 1/1997 Ferrara, Jr. ..... 222/402.12
5,862,960 A 1/1999 Miller et al.
6,202,896 B1 * 3/2001 Bonningue ..... 222/321.1
6,332,562 B1 12/2001 Sweeton
6,494,349 B1 12/2002 Thompson et al.
D489,970 S * 5/2004 Nelson et al. ..... D9/688
6,981,658 B2 1/2006 Streutker et al.
2005/0103811 A1 * 5/2005 Heukamp ..... 222/402.13

FOREIGN PATENT DOCUMENTS

CH 612 363 7/1979
JP 49-121553 6/1975
JP 49-103637 3/1976

* cited by examiner

SPRAYER ACTUATOR, SPRAYER, AND METHOD OF MAKING THE SAME

FIELD OF THE INVENTION

The present invention relates to a sprayer, a sprayer actuator, and a method of making the same.

BACKGROUND OF THE INVENTION

Pressurized containers of the aerosol type have been traditionally equipped with an actuating button or cap, which button or cap defines a product duct through which the product passes to the discharge orifice situated within the button or cap. To discharge product from the container, the user grasps the container and with one finger of the grasping hand depresses the button or a portion of the cap to release the contents of the container.

While achieving substantial commercial success, finger actuated buttons or caps have the disadvantage of inducing finger fatigue for some users. Moreover, with the prior systems of actuation, the aiming of the discharged product to the desired surface area suffers somewhat due to the relatively awkward gripping and finger placement. A more natural grasping and actuation of the container is achieved through the use of a trigger mechanism. Examples of prior trigger actuated aerosol containers are disclosed in U.S. Pat. Nos. 3,189,232, 3,580,432; 3,987,942; 5,862,960; and 6,494,349 B1. In addition, some prior spray containers are only held by a few of the user's fingers. These may result in a less than adequately secure grip, and supporting the weight of the sprayer may place an undue strain on the user's fingers. Therefore, the search for improved sprayers has continued.

SUMMARY OF THE INVENTION

The present invention relates to a sprayer, a sprayer actuator, and a method of making the same. There are numerous embodiments of the sprayer, sprayer actuator, and method described herein, all of which are intended to be non-limiting examples, and there are numerous aspects thereof that may constitute inventions in their own right.

In one embodiment, an ergonomic sprayer actuator is disclosed. The sprayer actuator comprises a housing having an upper portion, a lower portion for fitting on or over a can or other container, and a narrowed waist portion between said upper portion and said lower portion.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE INVENTION

Figure 1:
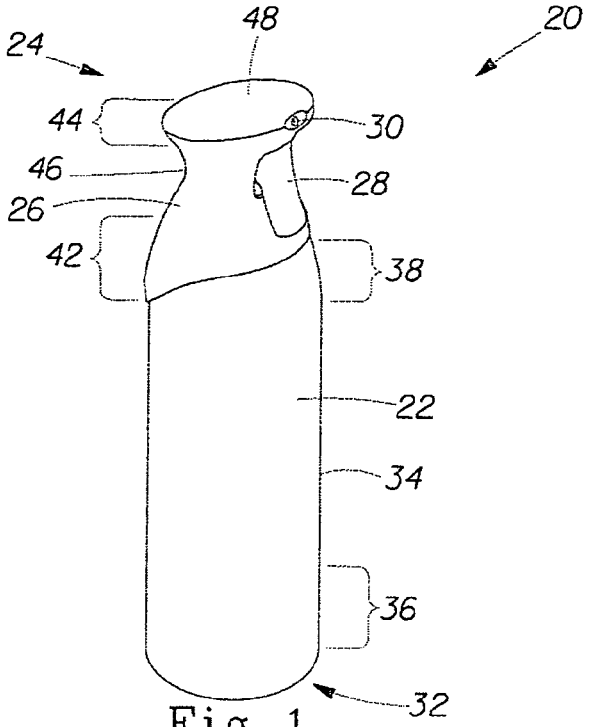
FIG. 1 is a perspective view of one non-limiting embodiment of a container having a sprayer actuator thereon.

The present invention relates to a sprayer, a sprayer actuator, and a method of making the same. FIG. 1 shows one non-limiting embodiment of a sprayer 20. As shown in FIG. 1, the sprayer (or "spray container") 20 comprises a container 22 and a sprayer actuator (or "actuator") 24. The sprayer actuator 24 comprises a housing 26, a trigger 28, and a nozzle 30. The sprayer 20 can be a pressurized container sprayer, such as an aerosol sprayer, or a non-aerosol trigger sprayer, or any other suitable type of sprayer which can benefit from the features described herein.

The container 22 can be any suitable type of container for holding a product to be dispensed by the sprayer. In some embodiments, it is desirable for the container 22 to be capable of holding contents that are under pressure and/or a propellant. The design of such containers in the form of metal cans is well known. The container 22 can be of any suitable shape. The container 22 has a base 32, sides 34, a lower portion 36, an upper portion 38, and a top 40 (shown in FIG. 4). In the embodiment shown, the container 22 is generally cylindrical, but the sides 34 of the container taper inwardly with a slightly convex curvature on the upper portion 38 of the container. The container 22 is, thus, narrower at its upper portion 38. The container 22 can have numerous other shapes in different embodiments.

The container 22 can contain any suitable product that is capable of being sprayed by the sprayer 20. The product can be in any suitable form, including liquids, and other compositions. Examples of products include, but are not limited to: air freshening compositions, fabric freshening compositions, ironing aids such as spray starches, insecticides, paints, and other industrial, commercial, household, automotive, and/or garden compositions.

The container 22 can also include a propellant for dispensing the product therein. Any suitable propellant can be used. Suitable propellants include, but are not limited to: hydrocarbon propellants such as: isobutene, butane, isopropane, dimethyl ether (DME), or non-hydrocarbon propellants such as compressed gases which include, but are not limited to compressed air, nitrogen, inert gases, carbon dioxide, and mixtures thereof. In certain embodiments, such as in the case of air freshening compositions, it may be desirable for the propellant to be substantially free of hydrocarbon propellants.

Figure 5:
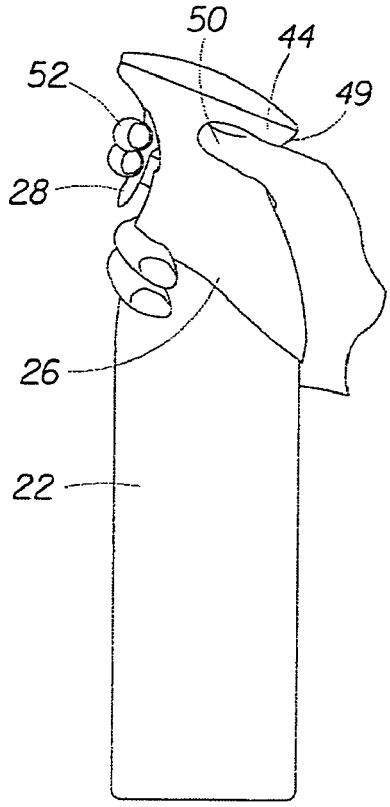
FIG. 5 is a side view of the spray container showing a user's hand holding the same.
Figure 6:
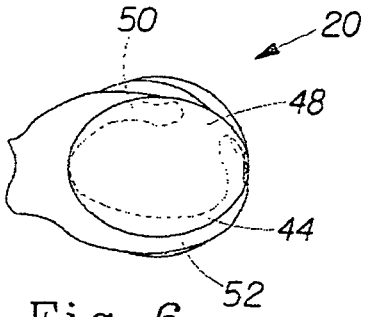
FIG. 6 is a view of the sprayer container from above showing a user's hand holding the same.

The actuator housing 26 in the embodiment shown, has a lower portion 42, an upper portion 44, a waist portion 46, and a top 48. The lower portion 42 fits on or over the container 22. As shown in FIG. 1, in this embodiment, the waist portion 46 is located between the lower portion 42 and the upper portion 44. The waist portion 46 is narrower than the widest portions of the upper and lower portions. The waist portion 46 provides the sprayer actuator 24 with an ergonomic design. Specifically, as shown in FIG. 5, in this embodiment, actuator housing 26 is configured so that a user can wrap at least their thumb 50 and forefinger 52 around the narrowed waist portion 46. In this embodiment, the sprayer actuator housing 26 is also provided with a configuration that permits it to comfortably fit the natural contour of the user's palm, such as in the crease in the user's palm. As shown in FIG. 6, when viewed from above, at least a part of the upper portion 44 extends outward beyond the portion of the user's thumb 50 and forefinger 52 that are in contact with the narrowed waist portion 46 to form a ledge.

The narrowness of the waist portion 46 makes the sprayer 20 easier to grip. In addition, since the upper portion 44 comprises at least portions that are wider when viewed from above than the portion of the user's hand that at least partially encircles the waist portion 46, the ledge formed by these portions of the upper portion 44 can rest on a portion of the user's thumb and forefinger to at least partially support the weight of the sprayer 20 during use. This can relieve the pressure on the user's fingers and/or wrist, particularly when the sprayer 20 is used for a prolonged period.

The upper portion 44 may comprise portions at the front, sides, and rear of the sprayer that are wider than the portions of the user's hand that are in contact with the narrowed waist portion 46. In other embodiments, the upper portion 44 need not have portions that are wider all the way around the sprayer than the portions of the user's hand that are in contact with the narrowed waist portion 46. Any suitable portion(s) of the upper portion 44 may extend laterally outward beyond the portions of the user's hand that are in contact with the narrowed waist portion 46. Such suitable portions include, but are not limited to on at least one of the sides, preferably both sides, and/or in the back of the sprayer.

In the embodiment shown in the drawings, the lower portion 42 of the actuator housing 26 is larger and extends downward further toward the base 32 of the container 22 in the back of the sprayer 20 than in the front of the sprayer. In other embodiments, the lower portion 42 of the actuator housing 26 may have a different configuration. For example, in other embodiments, all parts of the lower portion 42 of the actuator housing 26 can be of uniform length.

As shown in the drawings, in this embodiment, the upper portion 44 of the actuator housing 26 has a front, a back, and an underside 49. In the embodiment shown, both the underside 49 and the top 48 of the actuator housing 26 are angled or tilted upward from the back of the sprayer to the front of the sprayer. The fact that the underside 49 of the upper portion 44 is tilted so that the underside of said upper portion is higher in front than in the back allows the sprayer to be held more comfortably by a user without bending the user's wrist. In other embodiments, the top 48 (and/or the underside 49) of the housing can have a different configuration (e.g., flat, tilted downward, etc.). In some embodiments, it may even be possible to eliminate the top 48 of the housing 26 altogether.

In the embodiment shown in the drawings, the top 48 of the actuator housing 26 is tilted upward because the sprayer nozzle 30 is oriented so that liquid sprayed from the nozzle 30 will be directed at an angle of greater than 0° and less than 90°. That is, the liquid is not sprayed out parallel to the base 32 (that is, horizontally when the base is placed on a horizontal surface), nor is it sprayed out vertically (straight upward in the direction of the axis of the container). In other embodiments, the liquid sprayed from the nozzle 30 is directed at an angle of greater than or equal to about 30° and less than or equal to about 60°. In other embodiments, the liquid sprayed from the nozzle 30 is directed at an angle of about 45°. In other embodiments, the liquid sprayed from the nozzle 30 is directed at an angle of between about 20°-25°.

Figure 2:
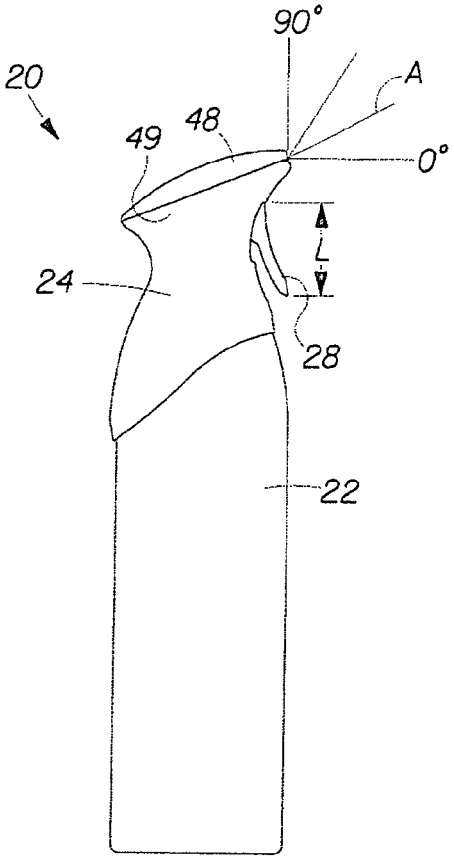
FIG. 2 is a side view of the spray container shown in FIG. 1.
Figure 3:
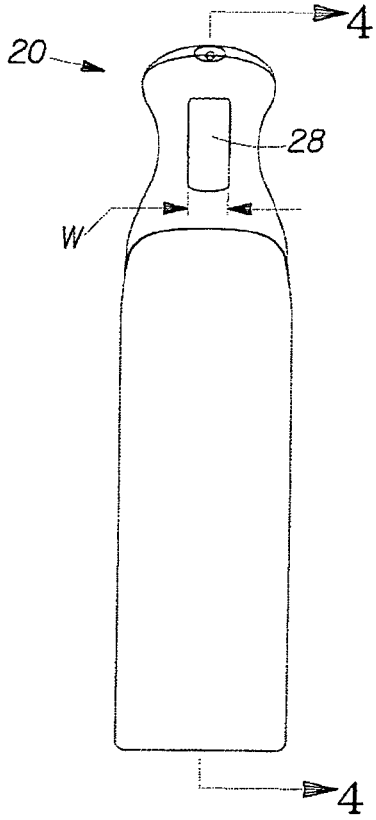
FIG. 3 is front view of the spray container shown in FIG. 1.

In other embodiments, however, it may be desirable for the liquid sprayed from the nozzle 30 to be sprayed horizontally (0°) or vertically (90°). In still other embodiments, such as in the case of an ironing aid, it may be desirable for the liquid sprayed from the nozzle 30 to be directed downward toward a surface (at an angle of between 0° and −90°). It is appreciated, however, that spray patterns are typically in the form of dispersions, and the spray emitted from a nozzle will form a dispersed spray pattern angle when viewed from the side. The angles of spray referred to herein are the central axis, A, as shown in FIG. 2, that bisects such a spray pattern. It is understood that portions of the spray pattern will typically be distributed on either side of this central axis.

The nozzle 30 may be configured to spray droplets of any suitable size. In one non-limiting embodiment, the nozzle 30 is configured to spray a plurality of droplets wherein at least some of the spray droplets have a diameter in a range of from about 0.01 μm to about 500 μm, or from about 5 μm to about 400 μm or from about 10 μm to about 200 μm. The mean particle size of the spray droplets may be in the range of from about 10 μm to about 100 μm, or from about 20 μm to about 60 μm. These size droplets may be useful in the case of air freshening compositions in which it is desired to suspend the droplets in the air for prolonged periods.

The sprayer actuator 24 comprises a trigger 28 operatively associated with the actuator housing 26 at the front of said sprayer. In the embodiment shown, the trigger 28 is also ergonomically designed. The trigger 28 is ergonomic in that it is relatively long, flat, and wide. This permits the user to not only activate the trigger with one finger, such as the user's index finger; it also allows the user to use two or more fingers (such as their index and middle fingers) to activate the trigger 28. This reduces fatigue on the user's index finger in the case of prolonged spraying. The trigger 28 can have any suitable dimensions. In certain embodiments, the trigger can have a length, L, of greater than or equal to about 1.25 inches (about 30 or 32 mm). In certain embodiments, the trigger 28 can have a width, W, of greater than or equal to about 7/16 inch (about 10 or 11 mm). For example, the trigger 28 may have a width of about 10/16 inch (about 15 or 16 mm). In other embodiments, the trigger 28 need not be ergonomically designed, and can be of a more conventional design and size.

Figure 4:
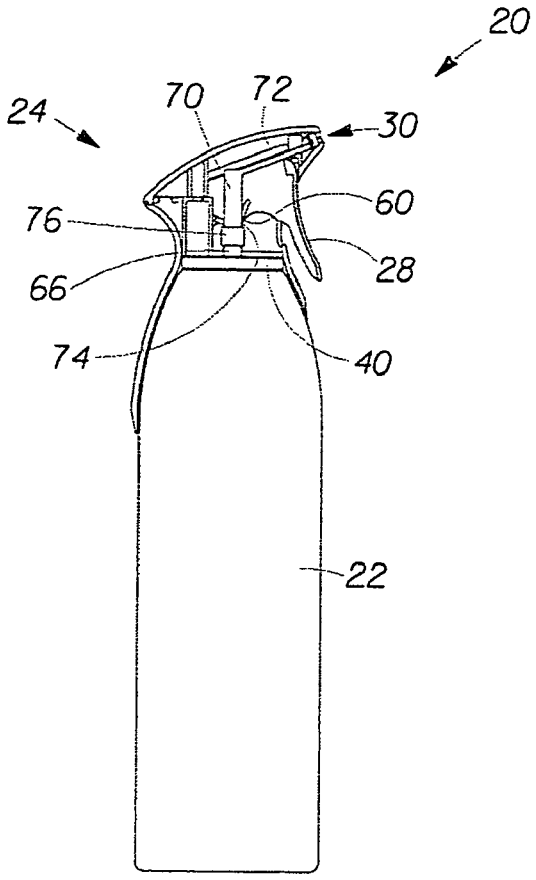
FIG. 4 is a cross-sectional view of the spray container taken along line 4-4 of FIG. 3.
Figure 7:
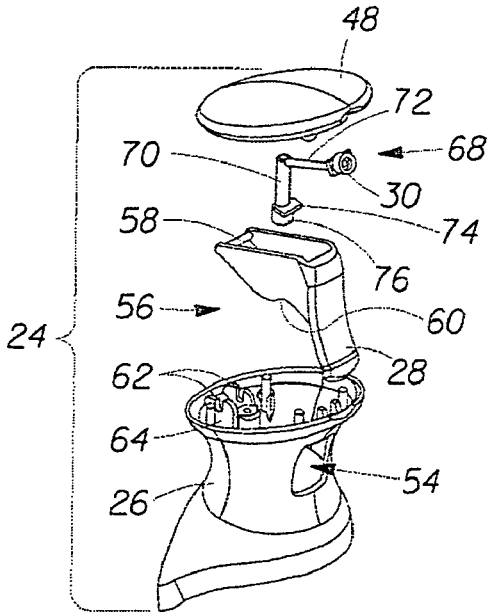
FIG. 7 is an exploded perspective view showing the assembly of the components of the sprayer actuator.

FIGS. 4 and 7 show the details of the inside of the sprayer actuator 24. As shown in FIGS. 4 and 7, this embodiment of the sprayer 20, the sprayer actuator 24 comprises the actuator housing 26 and trigger 28 described above. The actuator housing 26 has a hole or opening 54 in the front for the trigger 28. The trigger 28 is part of a larger trigger piece 56, and the rear of the trigger piece 56 has a bar 58 joined thereto, or integrally formed therewith. The trigger piece 56 also comprises a bearing portion 60. The bar 58 is configured to fit into recesses or slots 62 in shelves 64 that are located on the inside of the actuator housing 26, at the rear portion thereof. This allows the trigger piece 56 to rotate in a hinged fashion. The trigger 28, thus, extends from the front of the sprayer 20, and is operatively associated with the actuator housing 26.

The container 22, as shown in FIG. 4, can have a conventional valve stem 66 extending upward from the top 40 of the container. The sprayer actuator 24 further comprises a conduit 68. The conduit 68 has a first end and a second end. The conduit 68, in the embodiment shown, comprises several elements. These include: the nozzle 30 at the first end (or front) of the conduit 68; a first upstanding conduit portion (or "segment" or "leg") 70; a second angular conduit portion (or "segment" or "leg") 72; a platform 74; and a cap portion 76 at the second end of the conduit 68. The second conduit portion forms an angle, α, with said first segment 72 greater than 0°. In the embodiment shown in FIG. 4 where the sprayer is configured to direct the spray in at an upward angle, this angle α is greater than about 90° and less than about 180°. In the embodiment shown in the drawings, the nozzle 30 is held in a fixed location in the front of the actuator housing 26, and the cap portion 76 of the conduit 68 is fit over the valve stem 66 of the container 22. The first conduit portion 70 of the conduit 68 in this embodiment, is more rigid than the second conduit portion 72 (the latter is preferably flexible). In this embodiment, the conduit 68 serves the dual purpose of channeling the contents of the container 22 to the nozzle 30 where they can be sprayed out of the container 22, and also transmitting a downward force on the valve stem 66 to release the contents of the container 22.

The sprayer actuator 24 works in the following manner. When the user pulls the trigger 28 inward toward the actuator housing 26, this causes the bearing portion 60 of the trigger piece 56 to press down on the platform 74 on the conduit 68. This causes the first conduit portion 70 of the conduit 68 to move downward and activates the valve stem 66 of the container. Since the nozzle 30 is in a fixed position, the flexible nature of the second conduit portion 72 of the conduit 68 bends and permits this downward movement to take place. The valve stem 66 permits the contents of the container 22 to be released. The contents of the container flow through the conduit 68 and out the nozzle 30.

Numerous other embodiments having the features described herein are possible, a few of which are described below. In other embodiments, for example, the narrowed waist region can be formed by all, or a portion of, the container 22, rather than being formed entirely as part of the actuator housing 26. In various embodiments, the actuator 24 can be permanently affixed to the container 22, or the actuator 24 can be removably affixed to the container 22. The actuator 24 can be removably affixed to the container 22 in any manner known in the art for removably affixing an article to a container, including but not limited to by screw threads, bayonet fitments, and by a snap fit. In addition, rather than having the lower portion 42 of the actuator housing 26 overlap the outside of the upper portion 38 of the container, the actuator 24 and container 22 can be configured so that their outside surfaces are flush or form a substantially continuous surface.

In these or other embodiments, the conduit 68 need not comprise all of the elements described herein, and these elements can be provided as part of some other element of the sprayer actuator 24. In other embodiments, the nozzle need not remain in a fixed position at the front of the actuator housing 26. For example, it is possible for the nozzle 30 to be mounted so that it moves upward and downward when the trigger 28 is moved. In other embodiments, the conduit 68 need not comprise a first and second conduit portion in which one of the conduit portions is flexible and one is more rigid. In other embodiments, for example, the entire conduit 68 can be flexible, or the entire conduit can be rigid. However, this may change the way that the sprayer actuator functions.

Figure 8:
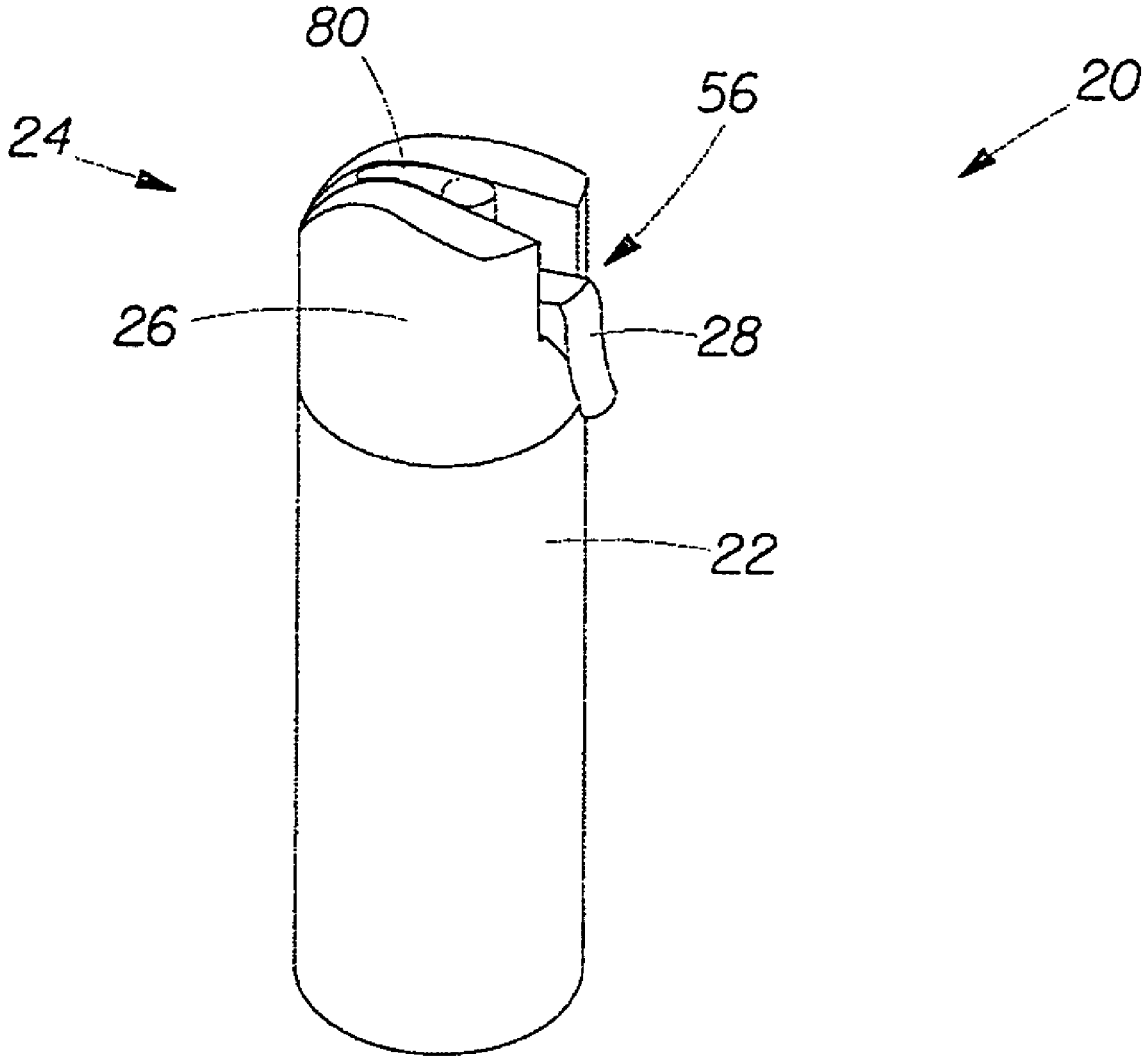
FIG. 8 is a perspective view of another embodiment of a sprayer which has a trigger disposed outside at least a portion of the actuator housing.

In other embodiments, the trigger piece 56 can comprise a portion of the actuator housing 26, or any other part of the actuator, rather than a separate component that is affixed to the actuator housing 26. Such a sprayer actuator need not comprise all of the features of the sprayer described herein. For example, FIG. 8 shows an example of a conventional sprayer 20 that has an actuating member, such as a push button 80 at the top of the actuator housing 26. This push button 80 is formed as part of the actuator housing 26, and is joined to the actuator housing 26 in a manner (such as with a living hinge that flexes) that permits the push button to move slightly downward and back upward. In the variation of the sprayer 20 shown in FIG. 8, a trigger piece 56 is joined to the front of the push button piece 80 to convert the sprayer into a trigger sprayer. In this embodiment, the trigger 28 resides outside of the front portion of the actuator housing 26. The trigger piece 56 can be joined to the push button piece in any suitable manner, or it can be molded as an integral part of the push button piece 80 and/or the actuator housing 26.

In still other embodiments, the trigger piece 56 and the conduit 68 can be formed as a single integral component.

FIG. 7 shows one embodiment of a method for assembling of the components of the sprayer actuator 24. As shown in FIG. 7, the sprayer actuator 24 is assembled as follows. The actuator housing 26 is provided in two portions comprising a side portion having a top that is at least partially open, a bottom that is at least partially open, and a front with an opening therein for the trigger, and a cap 48 for the actuator housing. The trigger piece 56 is inserted into said side portion of the actuator housing so that at least a portion of the trigger piece 56 extends outward through the opening in the front of the side portion of the housing to form a trigger 28. The conduit 68 is inserted into the side portion of the actuator housing 26 so that it is in fluid communication with the container 22 and operatively associated with the trigger 28. Finally, the cap forming the top 48 of the actuator housing 26 is placed on top of the side portion of the housing to form the sprayer actuator.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

While particular embodiments of the subject invention have been described, it will be obvious to those skilled in the art that various changes and modifications of the subject invention can be made without departing from the spirit and scope of the invention. In addition, while the present invention has been described in connection with certain specific embodiments thereof, it is to be understood that this is by way of illustration and not by way of limitation and the scope of the invention is defined by the appended claims which should be construed as broadly as the prior art will permit.

What is claimed is:

1. An ergonomic sprayer actuator comprising:

a container comprising a base, sides, and a top;

a sprayer actuator comprising a housing having an upper portion, a lower portion for fitting on said container, and a narrowed waist portion between said upper portion and said lower portion, wherein said upper portion comprises a front, a rear, and sides, wherein said housing is configured so that a user can wrap at least their thumb and forefinger around the narrowed waist portion and, when viewed from above, at least the sides and rear of said upper portion extend outward beyond the portion of the user's thumb and forefinger that are in contact with the narrowed waist portion, and wherein said lower portion overlaps at least partially said sides of said container.

2. The ergonomic sprayer actuator of claim 1 wherein the front, sides, and rear of the upper portion extend outward beyond the portion of the user's thumb and forefinger that are in contact with the narrowed waist portion.

3. The ergonomic sprayer actuator of claim 1 wherein said upper portion is configured so that it rests on a portion of a user's thumb and forefinger to at least partially support the weight of the sprayer during use.

4. The ergonomic sprayer actuator of claim 1 wherein said upper portion has a front, a back, and an underside, and said upper portion is tilted so that the underside of said upper portion is higher in front than in the back.

5. The ergonomic sprayer actuator of claim 1 further comprising a nozzle at the front of said sprayer housing, wherein said nozzle is oriented so that liquid sprayed from said nozzle will be directed at an angle of greater than 0° and less than 90°.

6. The ergonomic sprayer actuator of claim 1 further comprising a nozzle at the front of said sprayer housing, wherein said nozzle is oriented so that liquid sprayed from said nozzle will be directed at a downward angle of less than 0° and greater than −90°.

7. The ergonomic sprayer actuator of claim 1 further comprising a trigger operatively associated with said sprayer housing at the front of said sprayer.

8. The ergonomic sprayer actuator of claim 7 wherein said trigger has a length that is sufficient to allow said trigger to be activated with two fingers.

9. The ergonomic sprayer actuator of claim 8 wherein the length of said trigger is greater than or equal to about 30 mm.

10. The ergonomic sprayer actuator of claim 7 wherein the trigger has a width, and the width of said trigger is greater than or equal to about 15 mm.

11. A sprayer comprising a non-pressurized container having a top and the ergonomic sprayer actuator of claim 1 which is joined to the top of the container.

12. A sprayer comprising a pressurized container having a top and the ergonomic sprayer actuator of claim 1 which is joined to the top of the container.

13. The sprayer of claim 12 wherein said pressurized container comprises a propellant, and at least a portion of said propellant comprises a compressed gas.

14. The sprayer of claim 13 wherein said compressed gas comprises one or more of the following: compressed air, nitrogen, one or more inert gases, and carbon dioxide.

15. The sprayer of claim 13 which is configured to provide a spray in the air in the form of a plurality of spray droplets, and t least some of the spray droplets have a diameter in a range of from about 0.01 μm to about 500 μm.

16. The sprayer of claim 13 which is configured to provide a spray in the air in the form of a plurality of spray droplets, and at least some of the spray droplets have a diameter in a range of from about 5 μm to about 4 μm.

17. The sprayer of claim 13 which is configured to provide a spray in the air in the form of a plurality of spray droplets, and at least some of the spray droplets have a diameter in a range of from about 10 μm to about 200 μm.

18. The sprayer of claim 15 wherein at least some of the spray droplets have a mean diameter by volume of between about 10-100 μm.

19. The sprayer of claim 15 wherein at least some of the spray droplets have a mean diameter by volume of between about 20-60 μm.

20. A sprayer actuator for fitting on a pressurized container comprising:

a valve stem;

a pressurized container comprising a base, sides, and a top;

a housing comprising a front, an upper portion, a lower portion, and a narrowed waist portion between said upper portion and said lower portion, wherein said housing is configured so that a user can wrap at least their thumb and forefinger around the narrowed waist portion and, when viewed from above, at least a part of said upper portion extends outward beyond the portion of the user's thumb and forefinger that are in contact with the narrowed waist portion, and wherein said lower portion overlaps at least partially said sides of said pressurized container, and wherein said lower portion of said housing extends downward further towards the back of said sprayer actuator than in the front of said sprayer actuator;

a trigger operatively associated with said housing at the front of said housing; and a conduit having a first end and a second end, wherein said first end of said conduit is configured to be positioned over the valve stem of a pressurized container, and the second end of said conduit has a nozzle operatively associated therewith, wherein said conduit is configured to provide fluid communication between a pressurized container and said nozzle.

21. The sprayer actuator of claim 20 wherein said conduit comprises two rectilinear segments that form an angle there between.

22. The sprayer actuator of claim 21 wherein said two rectilinear segments comprise a first segment that comprises the first end of the conduit, wherein said first segment is disposed in a substantially vertical orientation when the first end of the conduit is positioned over the valve stem of a pressurized container, and a second segment that forms an angle with said first segment of greater than about 90° and less than about 180°.

23. The sprayer actuator of claim 20 wherein said conduit is curved.

24. The sprayer actuator of claim 20 wherein at least a portion of said conduit is flexible.

25. The sprayer actuator of claim 22 wherein the second segment is flexible.

26. The sprayer actuator of claim 20 wherein said conduit further comprises a bearing platform.

27. The sprayer actuator of claim 20 wherein said nozzle held in a fixed position when said trigger is activated.

28. The sprayer actuator of claim 20 wherein said nozzle is moveable when said trigger is activated.

29. A sprayer comprising:

a container having a valve stem, a base, sides, a top, and a generally cylindrical body; and a sprayer actuator on said container comprising a housing, said housing comprising an upper portion, a lower portion for fitting on said container, and a narrowed waist portion between said upper portion and said lower portion, wherein said upper portion comprises a front, a rear, and sides, wherein said housing is configured so that a user can wrap at least their thumb and forefinger around the narrowed waist portion and, when viewed from above, at least the sides and rear of said upper portion extend outward beyond the portion of the user's thumb and forefinger that are in contact with the narrowed waist portion, and wherein said lower portion overlaps at least partially said sides of said container, and wherein said lower portion of said actuator housing extends downward further towards the back of said sprayer actuator than in the front of said sprayer actuator, and wherein said housing further comprises an actuating member at least indirectly in mechanical contact with said valve stem, having a trigger that is integrally formed with at least a portion of said housing and operatively associated with said housing at the front of said sprayer actuator.

30. The ergonomic sprayer actuator of claim 1, wherein said lower portion of said actuator housing extends downward further towards the back of said sprayer actuator than in the front of said sprayer actuator.

* * * * *